US006971947B2

(12) United States Patent
Artmann

(10) Patent No.: US 6,971,947 B2
(45) Date of Patent: Dec. 6, 2005

(54) AIRLESS BLASTER ARRANGEMENT

(75) Inventor: Josef Artmann, Duelmen (DE)

(73) Assignee: Schlick Roto-Jet Maschinebau GmbH, Metelen (DE)

( * ) Notice: Subject to any disclaimer, the term of this patent is extended or adjusted under 35 U.S.C. 154(b) by 0 days.

(21) Appl. No.: 10/483,653

(22) PCT Filed: Jul. 22, 2002

(86) PCT No.: PCT/DE02/02671

§ 371 (c)(1),
(2), (4) Date: Feb. 6, 2004

(87) PCT Pub. No.: WO03/011525

PCT Pub. Date: Feb. 13, 2003

(65) Prior Publication Data

US 2004/0156718 A1 Aug. 12, 2004

(30) Foreign Application Priority Data

Jul. 23, 2001 (DE) ..... 101 35 845

(51) Int. Cl.[7] ..... B24C 5/06; B24C 3/30

(52) U.S. Cl. ..... 451/94; 451/95; 451/86; 451/89; 451/38

(58) Field of Search ..... 451/94, 95, 86, 451/89, 38

(56) References Cited

U.S. PATENT DOCUMENTS 2,092,201 A * 9/1937 Boesger ..... 451/86
2,363,437 A * 11/1944 Peterson ..... 451/95
2,369,408 A * 2/1945 Rosenberger ..... 451/95
3,368,308 A * 2/1968 Physioc, III ..... 451/2

FOREIGN PATENT DOCUMENTS

DE 195 36 723 A1 9/1995
DE 198 38 733 C1 8/1998

* cited by examiner

*Primary Examiner*—Joseph J. Hail, III
*Assistant Examiner*—Bryan Muller
(74) *Attorney, Agent, or Firm*—Milde & Hoffberg, LLP

(57) ABSTRACT

An airless blaster arrangement (100) for the surface treatment of objects with blasting agents, comprising an airless blaster (10) consisting of several radially arranged thrower blades (11) which are secured to at least one side disk (14). An area (12, 13) for the projection of blasting agents is respectively provided between two thrower blades. A distributor element (20) with a star-shaped cross-section formed by several guide ribs (21) extends coaxially with respect to the airless blaster (10) and is connected thereto in rotationally fixed manner. One guide rib (21) of the distributor element (2) is respectively joined to a thrower blade (11). A blasting agent guide channel (22) of the distributor element (20) leads into the blasting agent projection area (12).

12 Claims, 3 Drawing Sheets

AIRLESS BLASTER ARRANGEMENT

BACKGROUND OF THE INVENTION

The invention relates to an airless blaster arrangement for surface treatment of objects with blasting agents with a blasting agent supply tube, an impeller consisting of several radially-arranged thrower blades that are attached to at least one side disk, whereby a blasting agent discharge area is enclosed between each pair of thrower blades.

To treat object surfaces, blasting agent particles are accelerated to a high speed by means of impeller wheels that have an abrasive effect upon impact to the object, i.e., that remove rust, scale, or old paint layers, or that cause a change in structure to surface layers, during shot-peening, for example. The known impeller wheels are so shaped that the blasting agent is guided through a blasting agent supply tube to a distributor or an impeller, so that it is accelerated. The distributor or impeller is surrounded by a stream guide shell aperture that includes a stream guide shell aperture orifice. The blasting agent is transported through the stream guide shell aperture orifice into the inner blasting agent discharge area between the thrower blades. There, it is passed to the outer blasting agent discharge area because of inertia and gravity forces along with the imparted radial speed, and finally to the periphery of the impeller wheel, where it is decelerated by the peripheral speed of the edge of the impeller wheel.

Experiments have shown that the flow paths of the blasting agent are influenced by strong turbulence within the interior of a blast turbine, and strongly deviate from the flow relationships of the assumed model and the design of the known airless blaster arrangement. These turbulences strongly brake the motion of the blasting agent within the airless blaster arrangement, and also cause increased wear because of strong scattering. Thus, wear of the theoretically blasting agent-free rear sides of the thrower blades may be found which is attributed to chaotic motion of the blasting agent, particularly in the blasting agent discharge area between two thrower blades.

This problem is also based on the conventional airless blaster arrangement disclosed in the German Patent No. DE 195 36 723 A1. This reference recommends implementing the impeller as an auxiliary impeller wheel. This achieves an eccentric supply of the blasting agent. The blasting agent should move along a circular path before its entry into the blasting agent discharge area, and should perform a spiral-shaped movement upon leaving the distributor through the stream guide shell aperture orifice, whereby impact of the blasting agent onto the thrower blades is to be substantially prevented. Additional auxiliary thrower blades are necessary for the further channeling of the movement of the blasting agent, based on the state of the art, by means of which the number of wear parts is increased. Also, only this channeling reduces the effects of chaotic blasting agent motion without significantly treating the causes. The stream guide shell aperture is still required in order to influence the position and width of the blasted sector.

The German Patent No. DE 198 38 733 C1 specifies another arrangement based on the principle of an eccentric supply of the blasting agent in which the supply aperture of the blasting agent supply tube opens eccentrically to the auxiliary impeller wheel so that the blasting agent is transferred directly into the blade chamber of the auxiliary impeller wheel. The above-mentioned disadvantages of a mere weakening of a chaotic blasting agent motion and the requirement for a stream guide shell aperture also apply in this case.

SUMMARY OF THE INVENTION

It is therefore the object of the invention to develop a airless blaster arrangement of the type mentioned at the outset in such manner that the blasting agent is passed via a defined flow motion into the blasting agent discharge area, and friction and wear caused by turbulent motion are reduced.

This object is achieved by the invention in that a distributor with an essentially star-shaped cross-section guide path formed from several guide paths extends coaxially from the impeller wheel and is connected to it so that it rotates with the impeller wheel, whereby a guide blade of each distributor is connected to a thrower blade of the impeller wheel, and whereby a blasting agent guide channel formed between each guide blade opens into an inner blasting agent discharge area of the impeller wheel.

It has been shown that a positioned flow path may be achieved by eliminating additional elements such as stream guide shell aperture and impeller. The blasting agent passes into the distributor with the eccentrically-positioned stream guide channels and is passed through a longer path. Resultantly, the turbulence still present in the narrow blasting agent guide channels is reduced and the blasting agent is forced into guided movement. Because of the fixed connection between the distributor and the impeller wheel, impact surfaces along the flow direction are avoided after the blasting agent has been guided into the blasting agent guide channels. Instead of this, a slight redirection of the blasting agent is achieved over large radii and angles. The guide blades are directly connected to the thrower blades. The blasting agent guide channels of the distributor open like a funnel into the blasting agent discharge area of the impeller wheel and simulate a natural flow movement.

The following is achieved by the flow of the blasting agent according to the invention: a pre-defined amount of blasting agent is fed in a charge from the supply tube into a blasting agent guide channel. This batch of blasting agent is stored in a designed, pre-determined flow path until entry into the blasting agent discharge area since turbulence no longer occurs, for which it requires a specific, empirically-determined pause interval.

The time point and/or the location at which the batch may be influenced by means of a lateral and/or locally-controlled introduction of blasting agent from the supply tube into one of the blasting agent guide channels at which the batch passes into the blasting agent discharge area and is subsequently impelled. Thus, the stream guide shell aperture to limit the blasted sector, as required according to the state of the art, may be omitted. The flow speed may, for example, may be altered by the rotational speed of the impeller wheel, whereby place and time of the spin-off may be influenced.

In an especially advantageous embodiment of the invention, the blasting agent supply tube is positioned at an angle of 45–90° to the rotation axis and opens at the circumference of the distributor in at least one blasting agent guide channel. Thus, the function of the blasting agent batch occurs simultaneously in one charge. This function may occur very quickly with a rotating distributor: the lateral open blasting agent guide channel, just like a transporting wheel, grabs a batch from the supply tube and continues to rotate. The guide blades extending backwards with the rotation briefly stop the flow out of the supply tube for a moment until the next empty blasting agent guide channel is in front of the supply tube.

Another exemplary embodiment of the invention, in which the blasting agent supply tube may be displaced at least along a batch of the axis of the distributor, is also advantageous. In contrast to changing rotational speed, this possesses the advantage that the effects of a displacement of the supply point may be directly determined, while one must await achieval of the new rotational speed each time the rotational speed is changed.

The quantity of blasting agent that is impelled from each rotating thrower blade, and thereby the sector blasted by the airless blaster arrangement, are influenced by the length of the given batch. It is therefore advantageous if the blasting agent supply tube includes an aperture nozzle whose inner dimension is adjustable, so that charges of varying lengths of blasting agent that lead to an alteration in the blasting image length may be stored.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
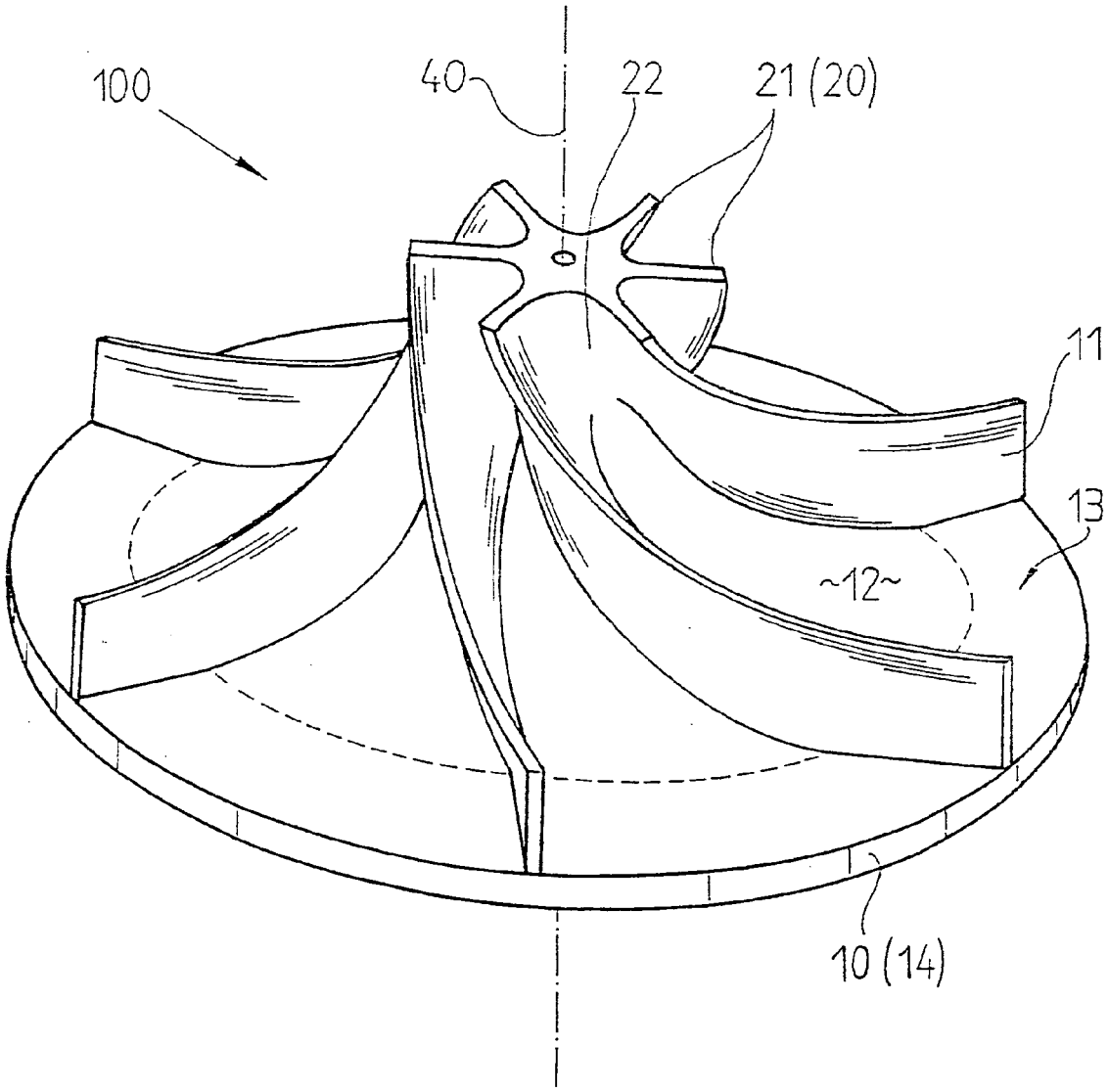
FIG. 1 is a perspective view of the airless blaster arrangement according to the invention.

The preferred embodiments of the present invention will now be described with reference to FIGS. 1–3 of the drawings. Identical elements in the two figures are designated with the same reference numerals.

As FIG. 1 shows, the guide blades 21 of the distributor 20 extend until they become the thrower blades 11 of the impeller wheel 10. The blasting agent guide channels 22 open as a funnel into an inner blasting agent discharge area 12, each of which is located between thrower blades 11. The smooth, strongly-rounded flow paths allow guided flow of the blasting agent, and do not allow turbulence to form at all. Because of the eccentrically-positioned, relatively narrow blasting agent guide channels 22, the blasting agent is guided along the periphery of the distributor 20 to the impeller wheel 10, and is forced into predetermined flow paths. The inner blasting agent discharge area 12 continues seamlessly into outer blasting agent discharge area 13 that extends as far as the edge of the impeller wheel 10. While the inner blasting agent discharge area 12 is preferably shaped as a type of cavity positioned obliquely with respect to the rotational axis 40, in order to achieve as smooth a transition as possible from the blasting agent guide channels 22 to the inner blasting agent discharge areas 12, the outer blasting agent discharge areas 13 are positioned 90° to the rotation axis in order to ensure that the blasting agent is impelled at a right angle to the rotation axis.

The distributor 20 is preferably in the form of a helical gear or a worm conveyor. It is likewise possible to drill the distributor 20 either along a portion of its length or over the entire length. This achieves the fact that the blasting agent guide channels 22 are positioned oblique to the rotation axis 40, and that an axial forced flow in the direction of the impeller wheel 10 is created in the rotating distributor 20 by the increase of the guide blades 21, even when the rotation axis 40 is positioned horizontally.

Figure 2:
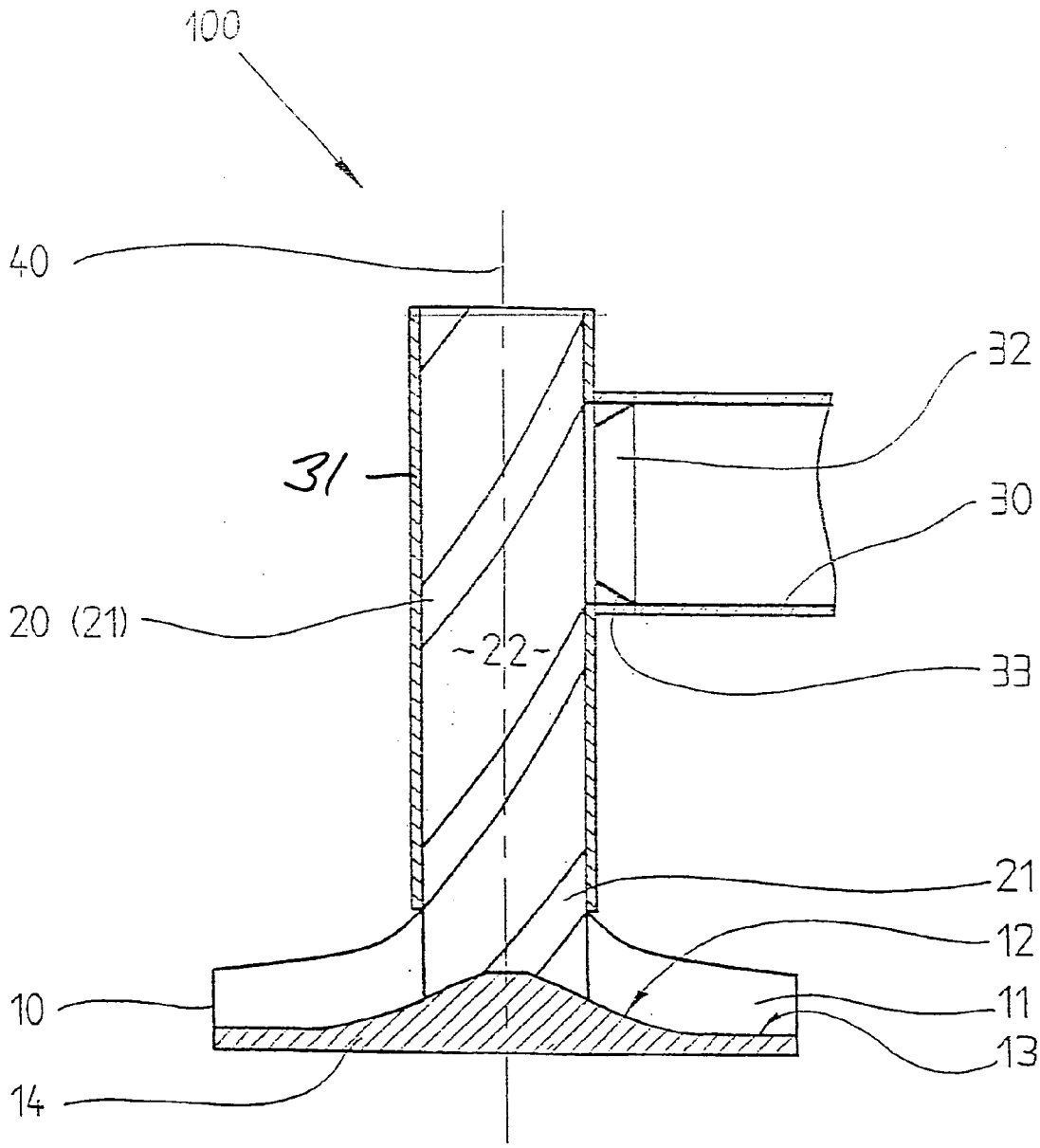
FIG. 2 is a cross-sectional view of the airless blaster arrangement seen through the rotational axis.

FIG. 2 shows the advantageous embodiment example of the airless blaster arrangement 100 in which the blasting agent is inserted at the periphery of the distributor 20. The rotatable distributor 20 is surrounded by a fixed shell tube 31, which has an aperture on its periphery, to which the blasting agent supply tube 30 is connected. The blasting agent supply tube 30 includes a nozzle 32 that itself includes adjustable sheet metal guides 33 in order to be able to adjust the length of the supplied charge of blasting agent. In the position shown in FIG. 2, the nozzle 32 opens into a blasting agent guide channel 22. Upon further rotation of the distributor 20, a guide blade 21 that slides in front of the nozzle briefly interrupts the blasting agent supply. The next blasting agent guide channel 21 is then filled in the same manner.

The impeller wheel 10 is formed together with the spiral distributor 20 as a pump wheel, and, at high speed, operates as an air pump so that blasting agent may be sucked up from the charge point along the blasting agent guide channels 22.

Figure 3:
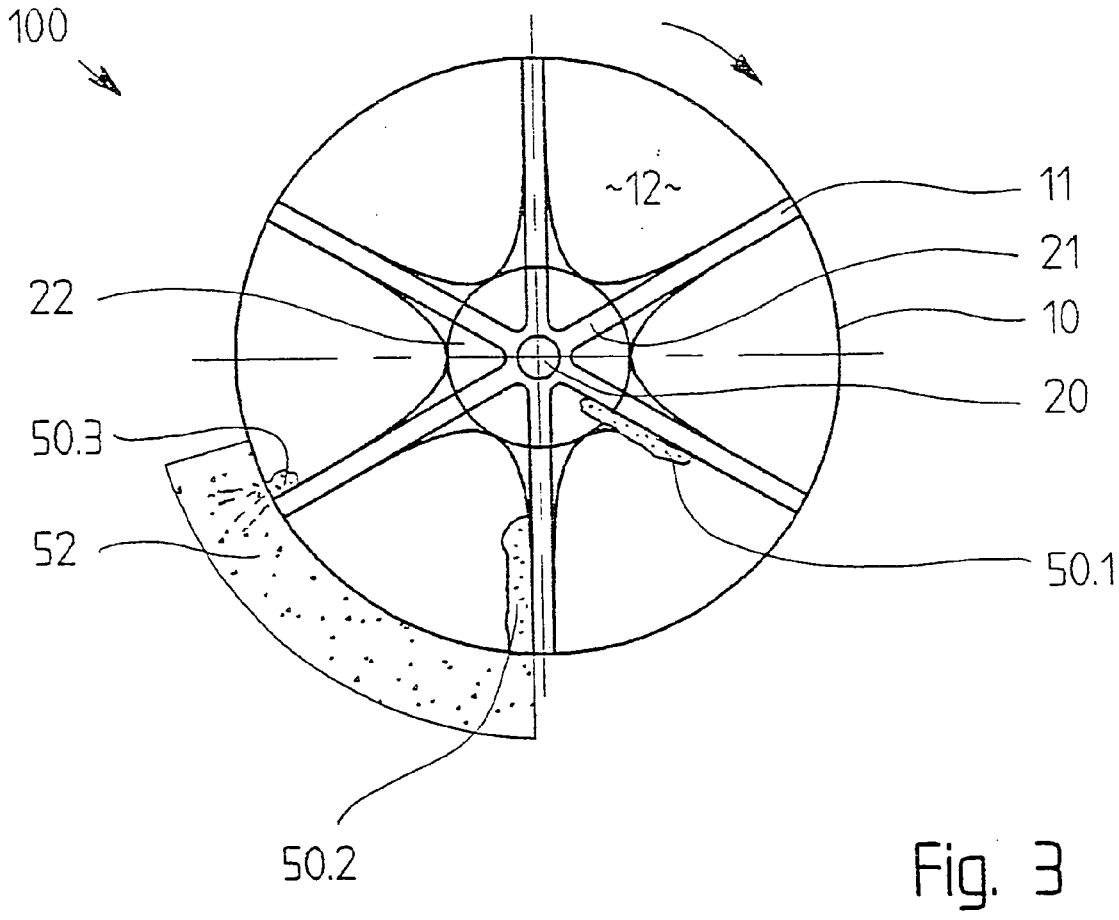
FIG. 3 is a top view of the airless blaster arrangement.

FIG. 3 shows schematically how a blasting agent batch 50.1 flows as a charge from the blasting agent guide channel 22 into the blasting agent discharge area 12 and from there moves along a thrower blade 11. The blasting agent batch 50.2 has already reached the outer circumference of the impeller wheel 10, and begins immediately to spin out. The blasting agent batch 50.3 is almost completely spun out. A blasted sector 52 is formed.

In the embodiment example according to FIG. 3, the distributor 20 is inserted into the impeller wheel 10 as a separate part, and matches it seamlessly. The two parts are so connected together that no rotational displacement of the distributor 20 with respect to the impeller wheel 10 may result. The components may, however, be separated from each other for service or in case of wear. This also applies to the thrower blades 11 which are attached in conventional fashion to the side disk 14 so that they may be removed.

There has thus been shown and described a novel airless blaster arrangement which fulfills all the objects and advantages sought therefor. Many changes, modifications, variations and other uses and applications of the subject invention will, however, become apparent to those skilled in embodiments thereof. All such changes, modifications, variations and other uses and applications which do not depart from the spirit and scope of the invention are deemed to be covered by the invention, which is to be limited only by the claims which follow.

What is claimed is:

1. In an airless blaster arrangement for surface treatment of objects with blasting agent, said arrangement comprising:

a blasting agent supply tube, an impeller wheel comprising several axially-positioned thrower blades that are attached to at least one side disk, wherein a blasting agent discharge area is enclosed between each pair of thrower blades, the improvement wherein a distributor with a star-shaped cross-section formed from several guide blades extends coaxially with the impeller wheel and is connected with it so that it rotates with the impeller wheel, said distributor being surrounded by a fixed shell tube which has an aperture in a sidewall thereof at its periphery to which the supply tube is connected; wherein each guide blade of the distributor is connected to a thrower blade of the impeller wheel; and wherein a blasting agent guide channel of the distributor formed between each guide blade opens into an inner blasting agent discharge area of the impeller wheel.

2. Airless blaster arrangement as recited in claim 1, wherein the blasting agent supply tube is positioned at an angle of from 45°–90° to the rotation axis and wherein the supply tube opens at the circumference of the distributor into at least one blasting agent guide channel.

3. Airless blaster arrangement as recited in claim 2, wherein the blasting agent supply tube is displaced along at least a part of the axis of the distributor.

4. Airless blaster arrangement as recited in claim 2, wherein the blasting agent supply tube includes a port nozzle whose inner width is adjustable.

5. Airless blaster arrangement as recited in claim 2, wherein the blasting agent supply tube includes a port nozzle whose opening matches the peripheral width of the blasting agent guide channel.

6. Airless blaster arrangement as recited claim 1, wherein the length of the blasting agent guide channels is one to five times the height of the thrower blades.

7. Airless blaster arrangement as recited in claim 1, wherein the guide blades are positioned oblique to the rotation axis of the distributor when viewed as a cross-section so that the distributor is formed as a helical gear wheel.

8. Airless blaster arrangement as recited in claim 1, wherein the guide blades of the distributor are so rotated with respect to each other along its length between the axial ends of the distributor so that the distributor possesses a helical shape.

9. Airless blaster arrangement as recited in claim 1, wherein the impeller wheel and the distributor are formed as one part.

10. Airless blaster arrangement as recited in claim 1, wherein the impeller wheel and the distributor are attached to each other so that they can be separated.

11. Airless blaster arrangement as recited in claim 1, wherein the level of the inner blasting agent discard area is positioned at an angle of from 45°–85° to the rotation axis.

12. Airless blaster arrangement as recited in claim 1, wherein the thrower blades are positioned radially on the side disk.

* * * * *